US006703784B2

(12) United States Patent
Vonallmen

(10) Patent No.: US 6,703,784 B2
(45) Date of Patent: Mar. 9, 2004

(54) ELECTRODE DESIGN FOR STABLE MICRO-SCALE PLASMA DISCHARGES

(75) Inventor: Paul A. Vonallmen, Phoenix, AZ (US)

(73) Assignee: Motorola, Inc., Schaumburg, IL (US)

( * ) Notice: Subject to any disclaimer, the term of this patent is extended or adjusted under 35 U.S.C. 154(b) by 79 days.

(21) Appl. No.: 10/174,234

(22) Filed: Jun. 18, 2002

(65) Prior Publication Data

US 2003/0230983 A1 Dec. 18, 2003

(51) Int. Cl.[7] ..... H01J 7/24

(52) U.S. Cl. ..... 315/111.71; 315/111.21; 313/485; 313/581

(58) Field of Search ..... 315/111.21, 111.31, 315/111.71, 169.1, 169.3, 169.4; 313/485, 574, 581, 618; 250/304, 309, 311

(56) References Cited

U.S. PATENT DOCUMENTS 5,455,489 A * 10/1995 Bhargava ..... 315/169.4
6,624,583 B1 * 9/2003 Coll et al. ..... 315/111.71
2002/0171367 A1 * 11/2002 Giapis et al. ..... 315/111.21

* cited by examiner

*Primary Examiner*—Don Wong
*Assistant Examiner*—Jimmy T. Vu
(74) *Attorney, Agent, or Firm*—William E. Koch

(57) ABSTRACT

A microcavity plasma discharge device comprising a microcavity device structure which includes N dielectric material structures wherein N is a whole number greater than or equal to one, each N dielectric material structure including a dielectric spacer region with a first opening wherein the dielectric spacer region is sandwiched therebetween a first dielectric material region with a second opening and a second dielectric material region with a third opening wherein the second opening and the third opening are positioned adjacent to the first opening to form a trench with a width and wherein a first conductive material layer is sandwiched between the dielectric spacer region and the first dielectric material region and a second conductive material layer is sandwiched between the dielectric spacer region and the second dielectric material region.

22 Claims, 1 Drawing Sheet

ELECTRODE DESIGN FOR STABLE MICRO-SCALE PLASMA DISCHARGES

FIELD OF THE INVENTION

This invention relates generally to micro-scale cavity discharge devices, and, more particularly, to generating a plasma for light emitter or chemical processing applications.

BACKGROUND OF THE INVENTION

Micro-scale cavity discharge (hereinafter referred to as "MSCD") devices have received considerable attention over the past years for potential application as ultraviolet (hereinafter referred to as "UV") light sources and in-situ chemical processing tools. One application for UV light sources is in plasma displays wherein the UV light is used to excite a phosphor. Among the large, flat, full color, high-definition television screens or panels currently available, the gas-plasma type panel has achieved considerable success. While these panels are quite light and thin, they can produce extremely sharp pictures. Another application of micro-scale UV light emitters is in chemical and biochemical sensing by fluorescence or absorption spectroscopy.

One application for in-situ chemical processing tools is in analyzing and synthesizing a gaseous atmosphere, such as an engine exhaust or the like where it is desirable to detect and alter a chemical species. For example, a screen which includes an array of MSCD devices could be used to filter harmful chemicals from a gas flow and convert the harmful chemicals into more inert and less toxic species.

Low temperature co-fired ceramics (hereinafter referred to as "LTCC") are particularly useful in the fabrication of MSCD devices because of the possibility to integrate micro-discharge devices with micro-fluidic devices and RF electronic components, which opens the door for numerous attractive applications.

Turn now to FIG. 1 which illustrates an example of a MSCD device 5 used in the prior art. In fabricating MSCD device 5, a ceramic material layer 10 is screen printed with a conductive material layer 12 and a ceramic material layer 14 is screen printed with a conductive material layer 16. Ceramic material layer 14 is positioned on conductive material layer 12 and a ceramic material layer 18 is positioned on conductive material layer 16 to form a ceramic material region 22. Region 22 is typically held together by applying a force or pressure to ceramic material region 22 so that layers 10, 12, 14, 16, and 18 are bonded together. A trench 20 is then punched through ceramic material region 22 wherein trench 20 typically has a cylindrical shape. Region 22 is then fired through a process well known to those skilled in the art.

Conductive material layers 12 and 16 function as two electrodes separated by a distance 19 which determines a breakdown voltage of MSCD device 5 wherein layers 12 and 16 are generally screen printed using a metal paste. The breakdown voltage is the voltage at which a plasma starts forming between layers 12 and 16. The area of exposed conductive regions 12 and 16 is substantially determined by a region 25 and a region 23, respectively. However, when trench 20 is punched, some of the metal paste used to screen print conductive material layers 12 and 16 is smeared in a region 21 on ceramic material layer 14 adjacent to trench 20. The smearing of the metal paste effectively changes distance 19 between conductive material layers 12 and 16 so that the breakdown voltage changes. Since the smearing is not a controllable process this leads to a lack of reproducibility of the MSCD device (i.e. the operating conditions are significantly different from one MSCD device to the next) in the discharge. Further, the metal paste used in the prior art to form layers 12 and 16 is susceptible to sputtering from electron and ion bombardment when MSCD device 5 is generating a plasma. The metal paste used in the prior art is also susceptible to oxidation which increases the breakdown voltage. Thus, the device structure and materials used in the prior art leads to unreliable performance (i.e. reproducibility and instability of the discharge and occasional failure of the plasma device to function at all) due to the smearing of the metal paste and to poor lifetime due to the sputtering of the electrodes.

Accordingly, it is an object of the present invention to provide a new and improved micro-cavity plasma discharge device with improved performance and longer lifetime.

SUMMARY OF THE INVENTION

To achieve the objects and advantages specified above and others, a micro-scale cavity device is disclosed. The MSCD device includes a micro-cavity device structure with N dielectric material structures wherein N is a whole number greater than or equal to one. Each N dielectric material structure includes a dielectric spacer region with a first opening wherein the dielectric spacer region is sandwiched between a first dielectric material region with a second opening and a second dielectric material region with a third opening. The second opening and the third opening are aligned with the first opening to form a trench with a width.

In the preferred embodiment, at least one of the first dielectric material region and the dielectric spacer region includes a first conductive layer with a surface positioned adjacent to the dielectric spacer region and an opposed surface adjacent to the first dielectric material region wherein the first conductive layer is sandwiched between the first dielectric material region and the dielectric spacer region.

In the preferred embodiment, at least one of the second dielectric material region and the dielectric spacer region includes a second conductive layer with a surface adjacent to the dielectric spacer region and an opposed surface adjacent to the second dielectric material region wherein the second conductive layer is sandwiched between the second dielectric material region and the dielectric spacer region.

In the preferred embodiment, the first conductive layer extends past one of the first dielectric material region and the dielectric spacer region into the trench to expose at least one of the surface and the opposed surface of the first conductive region. Further, the second conductive layer extends past one of the second dielectric material region and the dielectric spacer region into the trench to expose at least one of the surface and the opposed surface of the second conductive region. The first conductive layer behaves as a first electrode and the second conductive layer behaves as a second electrode.

In the preferred embodiment, the first dielectric material region, the second dielectric material region, and the dielectric spacer region include a low temperature co-fired ceramic. Further, the first and second conductive material layers include a platinum (Pt) paste.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the following drawings.

DETAILED DESCRIPTION OF THE PREFERRED EMBODIMENT

Figure 2:
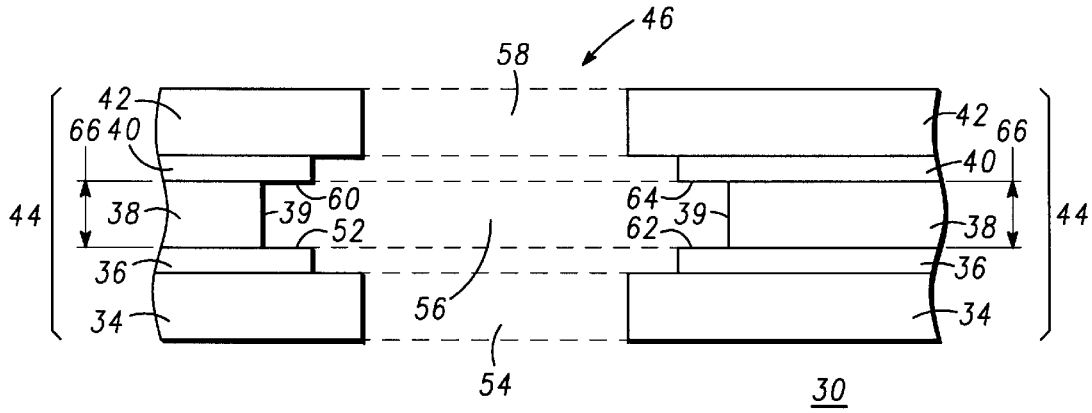
FIG. 2 is a sectional view of an embodiment of a simplified micro-scale cavity discharge device in accordance with the present invention.

Turn now to FIG. 2, which illustrates a simplified sectional view of a micro-scale cavity discharge device 30 in accordance with the present invention. Device 30 includes N dielectric material structures 44 wherein N is a whole number greater than or equal to one. While MSCD device 30 may be formed in a variety of different embodiments, including the formation of a cavity in a single thick layer, in a preferred embodiment, the cavity is formed through the cooperation of a plurality of thin layers fixed into a unit (e.g. firing layers and lamination of ceramic tape, bonding layers of polymer, etc.). Electrical connections and circuitry can then easily be formed on various layers to make a complete device once the layers are assembled and fixed.

A stack of dielectric layers is used to form the device wherein the dielectric material can be any convenient material which is capable of withstanding a plasma discharge within a micro-scale cavity discharge to generate a plasma based electromagnetic emission (as will be explained in more detail presently). Typical materials that can be used include ceramic, various polymeric material (e.g. PDMS or poly dimethyl sulfoxane), PMMA plus hybrid system, some materials used in the semiconductor art, etc. In the following description, for convenience, the layers are formed of green or unfired ceramic which, as explained below, is assembled and fired to form a single unit. It will be understood, however, that many of the steps of formation and usage described herein can be incorporated with other materials (e.g. various polymers and some materials used in the semiconductor art) in a similar fashion.

Each N dielectric material structure 44 includes a dielectric spacer region 38 with a thickness 66 sandwiched therebetween a dielectric material region 34 and a dielectric material region 42 wherein spacer region 38 includes a LTCC. In the preferred embodiment, N is equal to one for simplicity and to illustrate the basic structure and operation of device 30. However, it will be understood that N can be greater than one wherein device 30 will include a plurality of electrodes for each polarity of voltage, as will be discussed separately.

In the preferred embodiment, dielectric material region 34 includes an opening 54 and has a conductive material layer 36 positioned thereon region 34 wherein conductive material layer 36 is positioned adjacent to dielectric spacer region 38. Generally, dielectric material region 34 includes a LTCC wherein conductive material layer 36 is typically screen printed on region 34 in a desired pattern, as will be discussed separately.

In the preferred embodiment, dielectric material region 42 includes an opening 58 and has a conductive material layer 40 positioned thereon region 42 wherein conductive material layer 40 is positioned adjacent to dielectric spacer region 38. Generally, dielectric material region 42 includes a LTCC wherein conductive material layer 40 is typically screen printed on region 42 in a desired pattern, as will be discussed separately. It will be understood that regions 34, 38, and 42 are illustrated as a single layer for simplicity, but each region can include multiple layers.

In the preferred embodiment, openings 54, 56, and 58 are generally aligned to form a trench 46 with a width wherein device 30 forms a screen. Thus, a cavity (trench 46) has been formed without punching through region 44 so that the metal paste used to form layers 36 and 40 does not smear on a surface 39. The width of trench 46 is typically less than approximately 500 $\mu$m. Further, openings 54, 56, and 58 are generally circular in shape. However, it will be understood that openings 54, 56, and 58 can have other shapes, such as square, elliptical, or the like.

Illustrated in MSCD device 30 are layers of green or unfired ceramic materials with portions thereof broken away. As understood in the art, unfired or green sheets or layers (e.g. layers 34, 38, and 42) are formed of unfired or green ceramic material which usually includes aluminum oxide (AlO) particles, glass particles, and a binder, generally including organic material. Conductive layers 36 and 40 define electrodes and surround the openings. It will be understood that the electrodes can be electrically connected to additional electrical components, such as transistors, capacitors, inductors, resistors, or the like. The conductive layers can be formed by screen printing (or the like) a metal paste.

Trench 46 and layers 34, 36, 38, 40, and 42) form MSCD device 30. MSCD device 30 is capable of containing an environment for carrying a plasma discharge within trench 46 to generate a plasma based electromagnetic emission. Here it will be understood that the term "electromagnetic emission" includes UV to infrared emission, various particles (e.g. electrons, protons, ions, etc.), and any other emissions capable of being formed by the plasma discharge.

In the example, MSCD device 30 is formed as a ceramic module, but it will be understood that an array of MSCD devices could be included in a single ceramic module.

In the example of an array of MSCD devices, electrical traces can be included to connect the external connections for unique addressing (e.g. by row and by column).

While a single MSCD device is disclosed by FIG. 2, it will be understood by those skilled in the art that, for convenience in manufacturing, components of a plurality of modules are generally defined on each sheet. Also, laminated ceramic devices are generally formed using a plurality of the sheets (sometimes are many as fifty), which are stacked or positioned in overlying relationship. As is understood by those skilled in the art, the sheets are very thin (on the order of several tens to a few hundreds of microns) and, generally, the total number of sheets used depends upon the circuit or circuits being integrated. During the stacking process, the sheets are vertically aligned to form common modules sides and features (e.g. trench 46) through the entire stack (i.e. each module layer in a sheet overlies mating module layers in lower sheets).

After stacking and alignment of the sheets is accomplished, the stack is pressed under a uniaxial pressure (e.g. 0 psi to 5000 psi) at an elevated temperature (e.g. 500° C. to 1500° C.) to produce bonding between adjacent sheets. As understood by those skilled in the art, the pressure and temperature must be sufficient to produce some bonding between the binders of adjacent sheets.

Once the stack of unfired or green ceramic sheets has been bonded together, the stack can be cut or otherwise divided into individual modules. The cutting is easily accomplished since the sheets are still formed of unfired or green ceramic. As is understood in the art, the firing temperature is generally dictated by the composition of the green ceramic material. Generally, the green ceramic material includes aluminum oxide (AlO) particles, glass particles, and an organic binder. In most cases, the glass particles melt sufficiently to bind the aluminum particles together at a temperature of approximately 875° C. During the firing process, most of the organic binder is driven off to leave a ceramic comprising aluminum oxide (AlO) particles bound together by at the least partially melted and reformed glass. Also, the various sheets are bound into a virtually single structure by the firing process. In the firing process the individual modules contract or shrink approximately 13%, but the shrinkage is substantially uniform so that it does not affect the final module and the final size of features (e.g. trench 46) can easily be calculated.

MSCD device 30 is capable of containing an environment for carrying a plasma discharge within MSCD device 30 to generate a plasma based electromagnetic emission when a cathode discharge potential is applied to conductive layers 36 and 40. In this embodiment, the cavity (trench 46) is open at both ends so that a variety of environments, cathode discharge potentials, and pressures can be applied through an encompassing assembly (e.g. a larger housing, interconnecting conduits, etc.) to "tune" the cavity to various electromagnetic emissions. For example, the cavity can be tuned to change the electromagnetic emission to any desired emission in a range from infrared to ultraviolet.

In the preferred embodiment, the width of trench 46 adjacent to conductive material layer 36 is greater than the width of trench 46 adjacent to dielectric material layer 34. Further, the width of trench 46 adjacent to dielectric spacer region 38 is greater than the width of trench 46 adjacent to conductive material layer 36 so that a surface 52 with an area and a surface 62 with an area of conductive material layer 36 are exposed. In the preferred embodiment, the width of trench 46 adjacent to dielectric material layer 42 is less than the width of trench 46 adjacent to conductive material layer 40. Further, the width of trench 46 adjacent to conductive material layer 40 is less than the width of trench 46 adjacent to dielectric material layer 38 so that a surface 60 with an area and a surface 64 with an area of conductive material layer 40 are exposed. The plasma discharge is substantially generated within the region between surfaces 52 and 60 and within the region between surfaces 62 and 64. By forming trench 46 in this way, the alignment requirements of each successive layer (34, 36, 38, etc.) are less restrictive and are easier to accomplish, as will be discussed presently.

In the preferred embodiment, any misalignment in layers 34, 36, 38, 40, and 42 does not lead to variations in the total area of surfaces 52 and 62 nor in the total area of surfaces 60 and 64 as long as the width of trench 46 adjacent to conductive material layers 36 and 40 do not substantially overlap with the width of trench 46 adjacent to dielectric material regions 34 and 42, respectively, and as long as the width of trench 46 adjacent to conductive material layers 40 and 36 do not substantially overlap with the width of trench 46 adjacent to dielectric material region 38.

Figure 1:
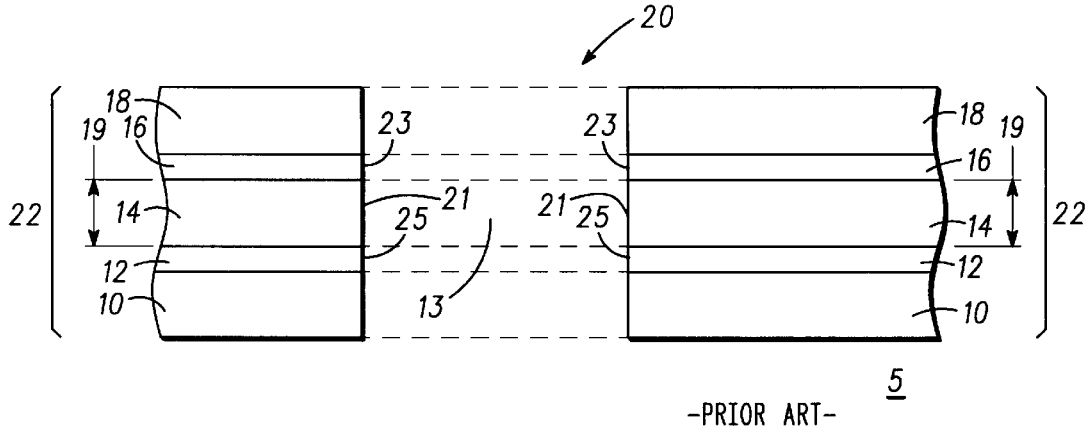
FIG. 1 is a sectional view of a prior art micro-scale cavity discharge device.

Thus, MSCD device 30 is more likely to operate with more uniformity from one device to another in an array of MSCD devices since it is easier to control the area of the electrode rather than its thickness. The area of the electrode in the prior art is determined by regions 23 and 25 adjacent to trench 20 (See FIG. 1) which is difficult to control and varies substantially from one device to another.

As discussed previously, dielectric material layers 34, 38, and 42 include a LTCC. However, it will be understood that layers 34, 38, and 42 could include other suitable dielectric materials. Further, in the preferred embodiment, conductive material layers 36 and 40 include a platinum (Pt) paste. However, it will be understood that layers 36 and 40 can include other conductive materials, such as a silver (Ag) paste, or any other suitable conductive paste which can be screen printed or otherwise applied. The platinum (Pt) paste typically has more stable operation with a lower breakdown voltage and an improved lifetime than for silver (Ag) pastes wherein silver (Ag) paste oxidizes and is sputtered more readily. A metal paste that does not sputter will have a longer lifetime and a metal paste that does not oxidize will have a smaller breakdown voltage. Further, layers 36 and 40 can also include other metals, such as platinum (Pt), gold (Au), silver (Ag), molybdenum (Mo), tungsten (W) or the like, which can be deposited with conventional semiconductor deposition techniques well known to those skilled in the art.

Conductive material layer 36 behaves as an electrode with a polarity and conductive material layer 40 behaves as an electrode with an opposite polarity to that of layer 36 wherein layers 36 and 40 are capable of forming an electric field therebetween. It will be understood that in embodiments where N is greater than one that each conductive material layer is capable of behaving as an electrode wherein each conductive material layer has a polarity which is the opposite polarity to each adjacent conductive material layer.

As discussed previously, surfaces 60 and 64 of conductive material layer 40 and surfaces 52 and 62 of conductive material layer 36 are left exposed so that a plasma discharge of device 30 is more stable and reproducible. Also, the close proximity (thickness 66) of conductive material layer 36 to conductive material layer 40 determines the breakdown voltage needed to form the plasma discharge within trench 46.

Figure 3:
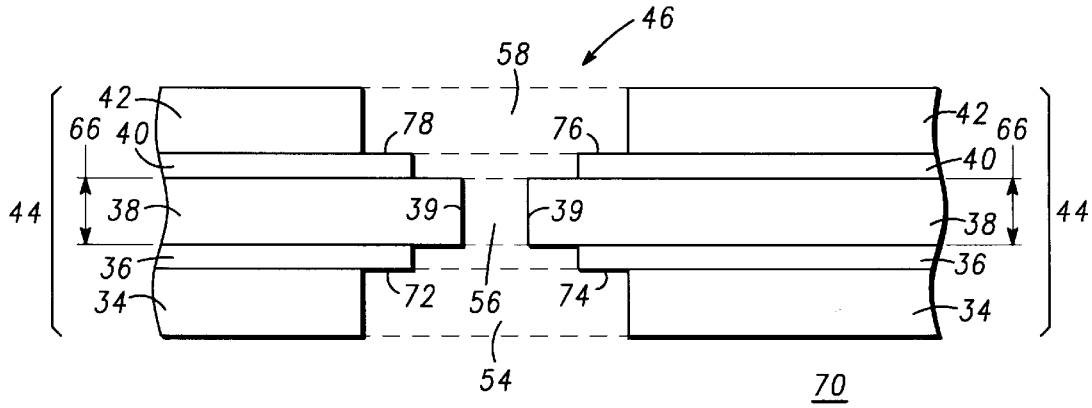
FIG. 3 is a sectional view of another embodiment of a simplified micro-scale cavity discharge device in accordance with the present invention.

Turn now to FIG. 3, which illustrates a simplified sectional view of another embodiment of a micro-scale cavity discharge device 70 in accordance with the present invention. Device 70 includes N dielectric material structures 44 wherein N is a whole number greater than or equal to one. In this embodiment, N is equal to one for simplicity and to illustrate the basic structure of device 70.

In this embodiment, the width of trench 46 adjacent to conductive material layer 36 is smaller than the width of trench 46 adjacent to dielectric material layer 34. Further, the width of trench 46 adjacent to dielectric spacer region 38 is less than the width of trench 46 adjacent to conductive material layer 36 so that a surface 72 and a surface 74 of conductive material layer 36 are exposed. In this embodiment, the width of trench 46 adjacent to dielectric material region 42 is greater then the width of trench 46 adjacent to conductive material layer 40. Further, the width of trench 46 adjacent to conductive material layer 40 is greater than the width of trench 46 adjacent to dielectric spacer region 38 so that a surface 78 and a surface 76 of conductive material layer 40 are exposed.

The plasma discharge is substantially generated within the region between surfaces 72 and 78 and within the region between surfaces 74 and 76. By forming trench 46 in this way, the alignment requirements of each successive layer (34, 36, 38, etc.) are less restrictive and are easier to accomplish and a plasma discharge of device 70 is more stable and reproducible.

Thus, a new and improved plasma discharge device has been disclosed which includes an electrode design that reduces the breakdown voltage needed to achieve electromagnetic emission. Further, the electrode design includes a platinum (Pt) paste which is substantially non-oxidizing and resistant to sputtering. An electrode that is resistant to sputtering improves the lifetime and stability of the plasma discharge device and an electrode that is non-oxidizing decreases the breakdown voltage needed to generate a plasma.

Applications of MSCD devices 30 and 70 include, but are not limited to, miniature UV light sources at wavelengths inaccessible to LED's where MSCD devices 30 and 70 are used to form a screen for a light emitting device wherein region 44 is sandwiched between a front glass plate and a rear glass plate and trench 46 is filled with an ionizing gas, such as argon (Ar), neon (Ne), or the like. MSCD devices 30 and 70 can be used in in-situ chemical processing applications such as deposition of catalyst, methanol reforming and surface modification for micro-fluidic applications. MSCD devices 30 and 70 can be integrated with microfluidic devices, detectors, and emitters to form compact microanalysis systems. The integration of these devices into a compact module greatly improves the operation of such systems.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A micro-scale cavity discharge device for generating a plasma, the device comprising:

a micro-cavity device structure which includes N dielectric material structures wherein N is a whole number greater than or equal to one, each N dielectric material structure including a dielectric spacer region with a first opening, said dielectric spacer region being sandwiched between a first dielectric material region with a second opening and a second dielectric material region with a third opening wherein the second opening and the third opening are aligned with the first opening to form a trench with a width;

wherein at least one of the first dielectric material region and the dielectric spacer region includes a first conductive layer with a surface adjacent to the dielectric spacer region and an opposed surface adjacent to the first dielectric material region, the first conductive layer being sandwiched between the first dielectric material region and the dielectric spacer region;

wherein at least one of the second dielectric material region and the dielectric spacer region includes a second conductive layer with a surface adjacent to the dielectric spacer region and an opposed surface adjacent to the second dielectric material region, the second conductive layer being sandwiched between the second dielectric material region and the dielectric spacer region;

wherein the first conductive layer extends past one of the first dielectric material region and the dielectric spacer region into the trench to expose at least one of the surface and the opposed surface of the first conductive region;

wherein the second conductive layer extends past one of the second dielectric material region and the dielectric spacer region into the trench to expose at least one of the surface and the opposed surface of the second conductive region; and wherein the first conductive layer is a first electrode and the second conductive layer is a second electrode.

2. The apparatus as claimed in claim 1 wherein the width of the trench adjacent to the first dielectric material region is substantially different than the width of the trench adjacent to the first conductive layer.

3. The apparatus as claimed in claim 1 wherein the width of the trench adjacent to the second dielectric material region is substantially different from the width of the trench adjacent the second conductive layer.

4. The apparatus as claimed in claim 1 wherein the width of the trench adjacent to the first and second dielectric material regions is substantially different than the width of the trench adjacent to the dielectric spacer region.

5. The apparatus as claimed in claim 1 wherein at least one of the first dielectric material region, the dielectric spacer region, and the second dielectric material region includes a low temperature co-fired ceramic.

6. The apparatus as claimed in claim 1 wherein at least one of the first and second conductive layers is formed with one of a platinum (Pt) paste, a silver (Ag) paste, and another suitable conductive paste.

7. The apparatus as claimed in claim 1 wherein at least one of the first and second conductive layers includes one of platinum (Pt), gold (Au), silver (Ag), and another suitable conductive material.

8. A micro-scale cavity discharge device for generating a plasma, the device comprising:

a first dielectric material layer with a first opening with a width;

a first conductive layer positioned on the first dielectric material layer wherein the first conductive layer includes a second opening with a width aligned with the first opening wherein the width of the first opening is substantially different than the width of the second opening;

a second dielectric material layer positioned on the first conductive layer wherein the second dielectric material layer includes a third opening with a width aligned with the second opening wherein the width of the second opening is substantially different than the width of the third opening;

a second conductive layer positioned on the second dielectric material layer wherein the second conductive layer includes a fourth opening with a width positioned aligned with the third opening wherein the width of the third opening is substantially different from the width of the fourth opening;

a third dielectric material layer positioned on the second conductive layer wherein the third dielectric material layer has a fifth opening with a width positioned aligned with the fourth opening wherein the width of the fourth opening is substantially different than the width of the fifth opening;

wherein the first opening, the second opening, the third opening, the fourth opening, and the fifth opening form a trench with a width;

wherein the first conductive layer is a first electrode and the second conductive layer is a second electrode.

9. The apparatus as claimed in claim 8 wherein the width of the trench adjacent to the first conductive layer is greater than the width of the trench adjacent to the first dielectric material layer and wherein the width of the trench adjacent to the second dielectric material region is greater than the width of the trench adjacent to the first conductive layer.

10. The apparatus as claimed in claim 9 wherein the width of the trench adjacent to the second conductive layer is less than the width of the trench adjacent to the second dielectric material region and wherein the width of the trench adjacent to the third dielectric material layer is less than the width of the trench adjacent to the second conductive layer.

11. The apparatus as claimed in claim 8 wherein the width of the trench adjacent to the first conductive layer is less than the width of the trench adjacent to the first dielectric material layer and wherein the width of the trench adjacent to the second dielectric material layer is less than the width of the trench adjacent to the first conductive layer.

12. The apparatus as claimed in claim 11 wherein the width of the trench adjacent to the second conductive layer is greater than the width of the trench adjacent to the second dielectric material region and wherein the width of the trench adjacent to the third dielectric material layer is greater than the width of the trench adjacent to the second conductive layer.

13. The apparatus as claimed in claim 8 wherein at least one of the first dielectric material layer, the second dielectric material layer, and the third dielectric material layer includes a low temperature co-fired ceramic.

14. The apparatus as claimed in claim 8 wherein at least one of the first conductive layer and the second conductive layer is formed with one of a platinum (Pt) paste, a silver (Ag) paste, and another suitable conductive paste which is substantially resistant to sputtering.

15. The apparatus as claimed in claim 8 wherein at least one of the first conductive layer and the second conductive layer includes one of platinum (Pt), gold (Au), silver (Ag), and another suitable conductive material.

16. A method of producing a plasma discharge from a micro-cavity discharge device, the method including the steps of:

providing a micro-cavity device structure which includes N dielectric material structures wherein N is a whole number greater than or equal to one, each N dielectric material structure including a dielectric spacer region with a first opening, said dielectric spacer region being sandwiched between a first dielectric material region with a second opening and a second dielectric material region with a third opening wherein the second opening and the third opening are aligned with the first opening to form a trench with a width;

providing at least one of the first dielectric material region and the dielectric spacer region to include a first conductive layer with a surface adjacent to the dielectric spacer region and an opposed surface adjacent to the first dielectric material region, the first conductive layer being sandwiched between the first dielectric material region and the dielectric spacer region;

providing at least one of the second dielectric material region and the dielectric spacer region to include a second conductive layer with a surface adjacent to the dielectric spacer region and an opposed surface adjacent to the second dielectric material region, the second conductive layer being sandwiched between the second dielectric material region and the dielectric spacer region;

providing the first conductive layer to extend past one of the first dielectric material region and the dielectric spacer region into the trench to expose at least one of the surface and the opposed surface of the first conductive region; and providing the second conductive layer to extend past one of the second dielectric material region and the dielectric spacer region into the trench to expose at least one of the surface and the opposed surface of the second conductive region wherein the first conductive layer is a first electrode and the second conductive layer is a second electrode.

17. The method as claimed in claim 16 wherein the width of the trench adjacent to the first dielectric material region is substantially different than the width of the trench adjacent to the first conductive layer.

18. The method as claimed in claim 17 wherein the width of trench adjacent to the second dielectric material region is substantially different than the width of the trench adjacent to the second conductive layer.

19. The method as claimed in claim 16 wherein the width of the trench adjacent to the first and second dielectric material regions is substantially different from the width of the trench adjacent to the dielectric spacer region.

20. The method as claimed in claim 16 wherein at least one of the first dielectric material region, the dielectric spacer region, and the third dielectric material region includes a low temperature co-fired ceramic.

21. The method as claimed in claim 16 wherein at least one of the first and second conductive layers is formed with one of a platinum (Pt) paste, a silver (Ag) paste, and another suitable conductive paste which is substantially resistant to sputtering.

22. The method as claimed in claim 16 wherein at least one of the first and second conductive layers includes one of platinum (Pt), gold (Au), silver (Ag), and another suitable conductive material.

* * * * *